US009217624B2

(12) United States Patent
Naud

(10) Patent No.: US 9,217,624 B2
(45) Date of Patent: Dec. 22, 2015

(54) SPOOLING PYROTECHNIC DEVICE

(71) Applicant: DMD Systems LLC, Los Alamos, NM (US)

(72) Inventor: Darren Naud, Los Alamos, NM (US)

(73) Assignee: DMD Systems LLC, Los Alamos, NM (US)

( * ) Notice: Subject to any disclaimer, the term of this patent is extended or adjusted under 35 U.S.C. 154(b) by 0 days.

(21) Appl. No.: 14/703,452

(22) Filed: May 4, 2015

(65) Prior Publication Data

US 2015/0233686 A1 Aug. 20, 2015

Related U.S. Application Data

(62) Division of application No. 13/431,841, filed on Mar. 27, 2012, now Pat. No. 9,062,943.

(51) Int. Cl.
*F42B 4/22* (2006.01)
*F42B 4/26* (2006.01)

(52) U.S. Cl.
CPC .... *F42B 4/22* (2013.01); *F42B 4/26* (2013.01)

(58) Field of Classification Search
CPC ..... F41F 1/00; F41F 1/06; F42B 4/00; F42B 4/02; F42B 4/04; F42B 4/06; F42B 4/08; F42B 4/10; F42B 4/20; F42B 4/22; F42B 5/067; F42B 5/16; F42B 29/00
See application file for complete search history.

(56) References Cited

U.S. PATENT DOCUMENTS 1,823,378 A * 9/1931 Scardone ..... F42B 4/02 102/357
2,459,687 A * 1/1949 Decker ..... F42B 4/02 102/342
3,611,935 A * 10/1971 Beckes ..... F42B 4/02 102/346
3,782,285 A * 1/1974 Froehner ..... F42B 4/02 102/340
4,132,149 A * 1/1979 Ashley ..... F42B 5/16 89/1.704
4,173,186 A * 11/1979 Dunham ..... F42B 29/00 102/430
4,335,657 A * 6/1982 Bains ..... F42B 5/045 102/433
4,570,540 A * 2/1986 Bell ..... C06B 45/10 102/202
4,643,071 A * 2/1987 Baechler ..... F41A 1/10 89/1.701
4,646,643 A * 3/1987 Goldenberg ..... F42B 7/12 102/430
4,938,145 A * 7/1990 Martwick ..... F42B 5/045 102/430
4,962,689 A * 10/1990 Phan ..... F41A 1/08 89/1.703
5,048,423 A * 9/1991 Garrett ..... F42B 5/045 102/430
5,239,928 A * 8/1993 Ricci ..... F42B 5/067 102/430
5,499,582 A * 3/1996 Schiessl ..... F42B 4/06 102/285
5,668,341 A * 9/1997 Reynolds ..... F41F 1/06 102/434
5,770,815 A * 6/1998 Watson, Jr. ..... F42B 5/16 102/439
5,954,563 A * 9/1999 Spriggs ..... A63H 37/00 102/357
6,079,310 A * 6/2000 Yagla ..... F41F 3/0413 89/1.816
6,283,033 B1 * 9/2001 Wu ..... F42B 4/24 102/336
6,312,537 B1 * 11/2001 Hiskey ..... C06B 43/00 149/36

(Continued)

*Primary Examiner* — Bret Hayes
*Assistant Examiner* — Derrick Morgan
(74) *Attorney, Agent, or Firm* — James C. Kennedy III, Esq. LLC; James Kennedy

(57) ABSTRACT

A pyrotechnic device including a combustion chamber including a wall, the combustion chamber containing combustible powder; an ignition source adapted to ignite said combustible powder within said combustion chamber; wherein the wall of the combustion chamber is adapted to burst at a predetermined pressure caused by combustion of the combustible powder; wherein the combustion chamber is disposed within a launch structure beneath a projectile and wherein a preselected amount of free space volume is disposed between said combustion chamber and said projectile.

20 Claims, 3 Drawing Sheets

(56) References Cited

U.S. PATENT DOCUMENTS 6,357,792 B1 * 3/2002 Shirk ..... B60R 21/272 137/68.13
6,412,416 B1 * 7/2002 Rouse ..... F42B 5/15 102/334
6,508,178 B2 * 1/2003 Shelton ..... F42B 4/08 102/347
RE38,592 E * 9/2004 Wu ..... F42B 4/06 102/336
7,004,074 B2 * 2/2006 Van Stratum ..... F42B 5/02 102/430
7,104,199 B2 * 9/2006 Walker ..... F41F 1/06 102/342
7,278,355 B2 * 10/2007 Yu ..... F42B 4/02 102/352
7,607,688 B2 * 10/2009 Kato ..... F42B 3/04 137/68.27
7,793,591 B1 * 9/2010 Van Stratum ..... F42B 4/26 102/336
8,402,893 B2 * 3/2013 Van Rooijen ..... F42B 4/22 102/335
8,539,884 B2 * 9/2013 Deye ..... F41A 19/63 102/206
8,677,904 B2 * 3/2014 Rexford ..... F42B 5/145 102/342
8,967,046 B2 * 3/2015 Dunaway ..... F42B 3/04 102/202
2003/0230211 A1 * 12/2003 Shelton ..... F42B 4/02 102/358
2004/0159259 A1 * 8/2004 Walker ..... F41F 1/06 102/335
2009/0179408 A1 * 7/2009 Brisighella, Jr. ..... B60R 21/26 280/741
2009/0308274 A1 * 12/2009 Schroeder ..... F41F 3/04 102/464
2010/0139516 A1 * 6/2010 van Rooijen ..... F42B 4/22 102/335
2010/0288152 A1 * 11/2010 Luebbers ..... F42B 5/16 102/430
2012/0217728 A1 * 8/2012 Jackson ..... B60R 21/2644 280/728.2
2014/0345487 A1 * 11/2014 Wu ..... F42B 30/10 102/357

* cited by examiner

SPOOLING PYROTECHNIC DEVICE

FIELD OF THE INVENTION

This invention relates to increasing the efficiency of a powder propellant, such as black powder to launch firework projectiles, whereby increased efficiency is achieved by encapsulating black powder in a burst chamber to enhance its ignition, attenuating the initial pressure pulse generated by the burst chamber with tree space or village, and utilizing a powder propellant of finer particle size to increase power output.

BACKGROUND OF THE INVENTION

Most fireworks or pyrotechnics contain black powder to launch projectiles or pyrotechnic effects from reusable launch tubes or one-use disposable cardboard tubes. An aerial shell is am example of a fireworks projectile, where the shell, made of plastic or cardboard, is loaded with fireworks effects such as colored stars, hummers, whistles, etc. A comet is an example of an effect that is propelled from a launch tube. Projectiles and effects come in many different shapes and sizes, but all are commonly manufactured with a propellant charge as a component. The propellant charge, or "lift charge," consists of a sieved fraction of granulated powder, for example, black powder.

Herein projectile is defined as shells or pyrotechnic effects which may be propelled by propellant powder, such as black powder.

The assembly or packaging of projectile lift charges includes propellant powder, such as black powder, of a specific sieve cut or granular size that is bagged and attached to the bottom of the projectile by string or tape. The bag, often made of paper or plastic film, must have within it an ignition source fired by external means. This ignition source may be an electric match with external wire leads, a fuse, or quick match. Quick match is a thin paper tube containing fine black powder that is specifically used for igniting devices with very short delays. These methods provide the means of igniting the lift charge and thereby launching the projectile.

Besides propelling projectiles, black powder may have a dual function of igniting time-fuses and/or the pyrotechnic effect itself. Shells usually contain a time-fuse, which serves as a time-delay element for ignition of the propellant charge within the shell. Effects may be coated with an easily ignitable outer layer or prime that takes fire readily from the burning black powder. Comets or stars are usually coated with prime and are ignited within the launch tube by the burning black powder.

Black powder, also referred to as gunpowder, includes an intimate mixture of potassium nitrate ($KNO_3$), charcoal and sulfur, produced by a manufacturing technique called the Corning process. This process typically involves the grinding of the chemical components moistened with water, pressing the resulting mix into cakes that are dried, crushed and sieved.

Black powder typically burns rapidly at relatively low pressures when ignited, producing the necessary hot, and burning gases to propel the projectiles. This attribute is unique to black powder and black powder propellant is preferable for launching projectiles.

Burn rate is defined herein as the rate of conversion of propellent to combustion gases, or more specifically, the mass of propellant converted to combustion gases per second per unit area of burning surface.

Those knowledgeable in the art of pyrotechnics understand that fine black powder can burn more quickly than coarse granular black powder, simply because fine powder has a greater available surface area for burning.

Projectiles are typically launched from tubes or mortars at pressures between 50 and 150 psi, but more desirably between 80 and 120 psi. These pressures are considered the operating pressures of black powder in launching projectiles. If the pressure is too low, the projectile may not be sufficiently accelerated and the apex height will not be reached. If the pressure is too high, the projectile may be destroyed, or damaged, or worse, the mortar may rupture. The above operating pressures may be suitable for achieving reasonable apex heights without risk of damage to the projectile or mortar.

The efficiency of the black powder to perform as a lift agent may greatly depend on its confinement. For example, black powder when laid out in open air may burn very slowly, perhaps taking several seconds to burn. When confined, black powder will typically combust at a rate resembling an explosion, completely burning within milliseconds. The greater the amount of free space volume (less confinement), or ullage, within the lift charge, the slower the black powder reaches a desired operating pressure. Likewise, if the confinement is too great, or the free space volume is too small, the actual black powder burn pressures will rapidly go beyond the desired operating pressure, which could cause rupture of the launch tube or damage to the projectile.

This effect of confinement is ascribed to what is referred to as pressure effects on burn rate. Burning black powder produces hot gases, which when confined in a chamber or vessel, will result in an increase of gas pressure. The black powder in turn will burn faster, thus producing still greater pressures. This positive feedback process is typically referred to as the pressure effect on burn rate. The burning of black powder is a complex, multi-step chemical and combustion process that occurs at the solid-gas interface. Higher pressures compress the gas phase at the interface thereby increasing the neat and mass transport of reaction species.

Other propellants, such as smokeless powders, require great confinement and pressures to achieve relatively fast burn rates. Smokeless powders are nitrocellulose-based formulations suitable for propelling bullets and heavy projectiles at high velocities. For example, exemplary nitrocellulose-based smokeless powders are described in U.S. Pat. No. 701,591 which is hereby incorporated by reference. The preferable operating-pressures of such propellants are in the thousands of psi, which far exceeds that of conventional fireworks of about 50 to 150 psi.

Propellants other than smokeless powder also experience pressure effects. Examples are solid rocket propellants and liquid propellant systems. These examples rely on the chemical conversion of solid or liquid propellants to hot gases via a combustion process, which accelerates with increasing pressures (i.e. pressure effect). The operating pressures of these examples, however, are greatly unsuitable for lifting pyrotechnic projectiles. Solid rocket propellants may require hundreds or thousands of psi to operate effectively. Similarly, liquid motors operate at relatively high pressures and indeed are inherently unsuitable and impractical as pyrotechnic lift propellants. Black powder is uniquely capable of producing the lifting at an operating pressure range suitable for pyrotechnics.

One problem with black powder as a lift propellant is that it produces copious amounts of smoke. It is well known that more than half of the combustion products are solids (e.g. potassium oxides, potassium carbonates) as well as noxious sulfur oxides from the combustion of sulfur. Because such combustion happens near the ground when lifting projectiles, the smoke produced by a fireworks display impacts the air quality at the ground level. The audience and crew can be affected by such smoke.

Attempts to use low smoke alternatives to black powder have proved difficult or impractical. U.S. Pat. No. 7,104,199 provides the expertise to utilize high pressures for fast combustion of nitrocellulose-based smokeless powders to launch pyrotechnic projectiles, but acknowledges that burning propellants lacks the heat to ignite delay fuses and primes of the projectiles. U.S. Pat. No. 8,402,893 in a similar fashion, uses a high pressure confinement technique to burn smokeless powder at its proper high operating pressures, and bleeds the resulting gases via small ports to step the pressure down to lower a lower operating pressures suitable for propelling firework projectiles.

The four basic disadvantages of this prior art method includes: (1) the high pressures required to burn smokeless powders requires a preferred metal vessel strong enough to handle the high pressures. This is expensive when compared to traditional systems employing cheap papery fiberboard, cardboard or plastic; (2) the use of metal in the primary containment may be potentially unsafe for the user or audience; and (3) the step-down depressurization of burning gases from high pressure vessel to the lifting chamber (the mortar) via small port holes would undesirably cool the gases. This cooling effect is universally known in gas dynamics as the Joule-Thomson Effect, and would impede the ignition of time delay fuses and primes of the pyrotechnic effect; (4) the separation of the lift agent from the pyrotechnic projectile requires the development of a "lift kit," which will result in an increased in time of preparing displays, increasing maintenance of the mortar tubes, and thus increasing labor and capital costs.

A non-propellant system using pressurized air together with electronic timed-delay fuses to launch projectiles is detailed in U.S. Pat. Nos. 5,627,338, 5,339,741, and 5,282,455. The inherent disadvantages of these prior art systems include high capital, maintenance and operating costs. In addition, special methods are required to ignite time delay fuses and primes of the projectiles since the propelling gases are cool.

Another method described in U.S. Pat. No. 6,645,325 employs an organic catalyst to increase the burn rate of raw nitrocellulose fibers. The burn rate increase is such that the nitrocellulose can burn at typical firework operating pressures. The organic catalyst, however, proved to be expensive to manufacture and unstable to moist air, making it impractical for use in the fireworks industry.

Therefore there continues to be a need to provide new methods and pyrotechnic devices for improving the efficiency of lift charges including propellant powder, such as black powder as the propelling agent in launching of firework projectiles while avoiding adverse affects such as adversely affecting the ignition of fuses and prime associated with the firework projectiles or pyrotechnic effects.

It is therefore an object of the invention to provide a pyrotechnic device and a method for making the same including an improved lift charge package including propellant powder, such as black powder as the propelling agent, to launch firework projectiles while avoiding adversely affecting the ignition of fuses and prime associated with the firework projectiles or pyrotechnic effects.

Another object of this invention is to increase the efficiency of the black powder as the propelling agent in the launching of firework projectiles. It has been unexpectedly found that in some embodiments the amount of needed amount of black powder compared to the amount used in traditional methods may be reduced by up to about 81%, and where such reduction may be accomplished a reliable manner without compromise on the ignition of time fuses and prime.

These and other objects, aspects and features of the invention will be better understood from a detailed description of the preferred embodiments of the invention which are further described below in conjunction with the accompanying Figures.

SUMMARY OF THE INVENTION

In an exemplary embodiment, a pyrotechnic device is provided that includes a combustion chamber including a wall, the combustion chamber containing combustible powder; an ignition source adapted to ignite said combustible powder within said combustion chamber; wherein the wall of the combustion chamber is adapted to burst at a predetermined pressure caused by combustion of the combustible powder; wherein the combustion chamber is disposed within a launch structure beneath a projectile and wherein a preselected amount of free space volume is disposed between said combustion chamber and said projectile.

BRIEF DESCRIPTION OF THE DRAWINGS

The disclosure will now be made, by way of example, with reference to the accompanying drawings, in which.

DETAILED DESCRIPTION OF THE PREFERRED EMBODIMENTS

Figure 1:
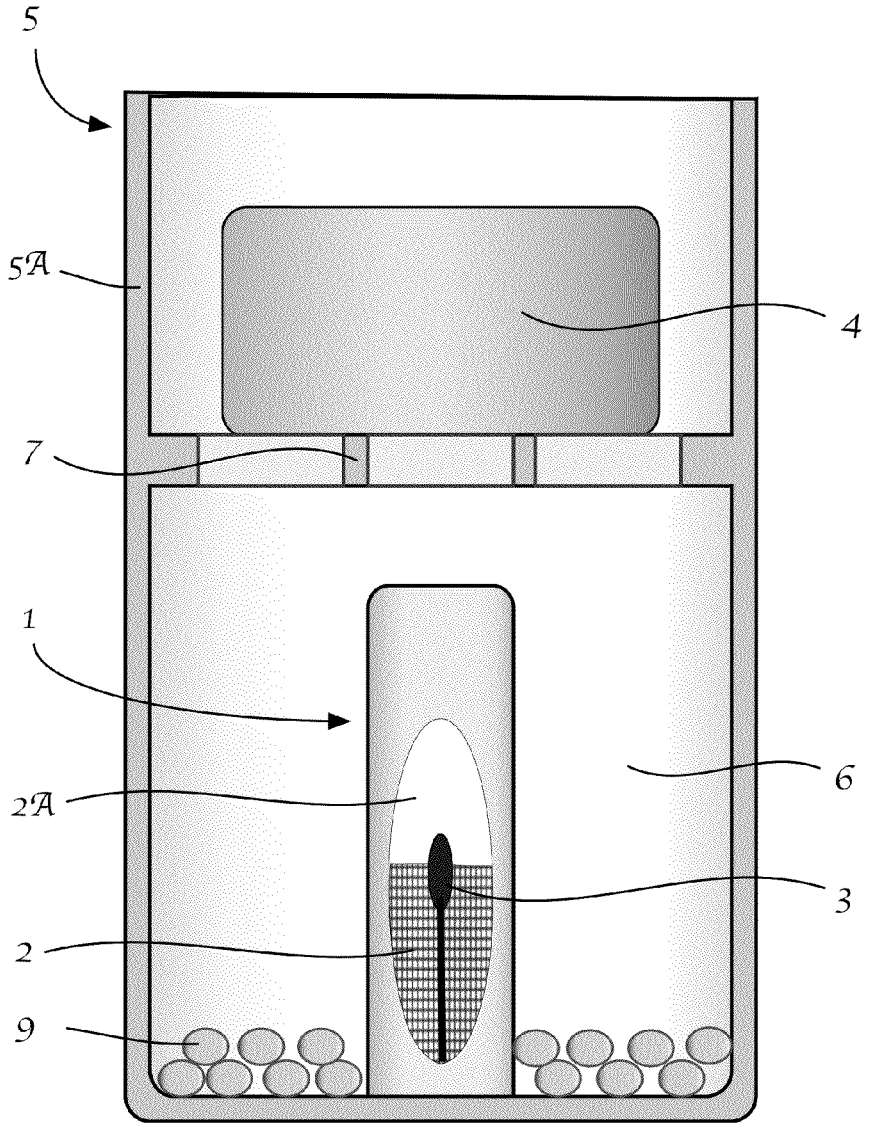
FIG. 1 is an illustration of an exemplary pyrotechnic device according to embodiments.

In one embodiment, a specially designed combustion chamber, or burst chamber, is employed to ensure proper, and preferably, full ignition of the entire combustible propellant powder, such as black powder lift charge, where the propellant powder lift charge is used to propel one or more pyrotechnic effects (fireworks projectile) from a launch tube (mortar).

In some embodiments, the burst chamber contains black powder and the ignition source, which may be an electric match. Other embodiments may include a fuse or a fast burning quick match as ignition sources.

In one embodiment, upon ignition, the confined gases produced by the burning black powder and contained by the burst chamber rapidly increase in pressure. The pressure and confinement of hot gases promotes flame spreading across available surfaces of the black powder granules. At some point the pressure within the burst chamber is too great, and the pressure splits the burst chamber to release ignited, burning black powder and pressurized hot gases to accelerate the projectile. This embodiment includes what is referred to as spooling the ignition of black powder, similar to that describing the spooling of a jet engine to pressure before the jet powered aircraft is allowed to accelerate for takeoff.

In some embodiments, spooling the ignition of black powder by means of a burst chamber ensures that most e.g., greater than about 50 percent, mere preferably greater than about 80 percent, even more preferably, substantially all of the granular black powder has ignited before it begins to provide the accelerating force onto the projectile, e.g., by being released from the chamber due to chamber bursting. This technique maximizes the efficiency of black powder as a lifting propellant.

In another embodiment, the burst chamber is designed and manufactured to fail, split or burst open within the pressure range of about 100-800 psi, preferably between about 250 and about 550 psi. This performance criterion is termed the bursting pressure. In some embodiments, for a brief time span, for example, under about one millisecond, a high pressure spike is produced at the moment when the burst chamber bursts open or fails. In some embodiments, discussed below, the burst chamber may burst by failing or splitting along predefined, weakened wall areas introduced into the burst chamber wall is) e.g., during manufacturing the burst chamber.

In some embodiments, free space or ullage around the burst chamber and/or under the projectile provides a means to attenuate the pressure spike produced at the moment the burst chamber fails, e.g., splits or bursts open. This high pressure spike typically precedes a longer lasting pressure pulse that is sustained by combusting black powder. This pressure spike, if not attenuated, can damage the projectile.

In some embodiments, the function of the free space or ullage may be to attenuate both the energy of a pressure spike and the pressure pulse to a level suitable for accelerating the projectile, i.e., accelerated at the operating pressure.

Black powder suitable for use as a pyrotechnic propellant, as described above, may be ground from dried cakes into granular powders. The powder is sieved into different sizes categories. Using an accepted method of powder classification, the particle sizes of black powder are denoted by FA and FG markings (classifications). FA is the largest grain (4 to 8 mm diameters), while 7 FA is the smallest grain (0.1 to 0.4 mm diameters). Again, FG is the largest grain (1.1 to 1.7 mm diameter), while FFFFFG (or 5 FG, circa 0.1 mm diameter) is the finest grain. In some embodiments, both FA and FG black powders series are acceptable for lifting fireworks projectiles. It is noted that particle size or granular size as used herein may refer to an average particle diameter and may be determined by several methods known in the art.

The power or release of energy as a function of time is dependent on the granular size of black powder. Relatively coarse black powder has a smaller surface area to burn, and therefore burns at slower speed and longer duration. Relatively fine black powder has a relatively greater burning surface area, and therefore burns at faster speed but with shorter duration.

Matching the coarseness of the black powder to function is important to achieve proper operating pressures. For example, military cannons require coarse black powder, while small arms require fine black powders. The same can be said for lift charges of pyrotechnic devices. Large diameter fireworks projectiles generally require coarse black powder (e.g. 3 FA or 2 FA), while smaller diameter fireworks generally require finer black powder (e.g. 2 FG 0.6 to 1.2 mm particle size) in the lift charges to achieve proper operating pressures.

For a given isobaric condition (constant pressure condition, e.g. 100 psi) the burn rate for black powder will remain constant per unit surface area. Under this condition, the rate of black powder combustion can be adjusted by selection of the particle size. Coarse black powder will burn at a slower rate than fine black powder, solely because of the difference in surface areas available for burning. Therefore, on a one-to-one mass basis, fine black powder can produce more power in the form of burning gases than coarse black powder.

The burn duration of black powder is dependent on its particle (granular) size. A large granule of black powder will burn longer than a small granule, given that the pressure conditions are the same for each.

Burning black powder produces the necessary pressure to accelerate a projectile within a mortar. The ran distance is the length of the mortar that the projectile travels. Once the projectile exits the mortar (launch tube/lift chamber), the built up pressure dissipates and the projectile will no longer be accelerated. The run distance affects the duration of acceleration created by the pressure. The longer the run distance, the longer the pressure can impart a force of acceleration onto the projectile.

In some embodiments, proper selection of the black powder particle size may be critical for improved efficiency projectile lifting. A too small particle size will burn too quickly and accelerate the projectile too rapidly, possibly damaging or destroying it. A too large particle will provide insufficient acceleration and continue to burn past the moment the projectile exits the mortar. A properly sized black powder granule should desirably ignite and burn to completion just before the projectile exits the mortar. In some embodiments, the firework propellant powder, such as black powder may have a particle size from about 0.1 mm up to about 8 mm in diameter, depending among other things on the launch tube size, e.g., diameter and run distance.

In some embodiments, as shown by experimentation, FFG (or 2 FG) black powder is most suitable for the spooling method described above. In related embodiments, because much less black powder is used in this method, a black powder that has a higher power output is required. In one embodiment, increasing the power output of black powder is most easily achieved by using grannies with higher surface area or of smaller diameter.

In another embodiment, as shown by experimentation, use of the spooling method may cause the 2 FG black powder to be completely burned before the projectile exits the mortar. This ensures most of the energy produced by the black powder is efficiently converted to propelling the projectile. Therefore, in some embodiments, 2 FG black powder, or black powders of comparable sizing, may be the most suitable for run distances of typical mortars in the fireworks industry.

Experimentation has shown that black powder in prior art lifting methods (e.g. using a bagged method) burn past the moment the projectile exits the mortar. This is attributed to the fact that large amounts of black powder of relatively large granular size (low surface area) is required to achieve proper operating pressures. Such large granules burn too long for the run distance of the mortar. In contrast, if one were to use a smaller particle size in prior art lifting methods, pressures above the desired operating pressure (e.g. above 150 psi, or the preferred range of 80-120 psi) will be obtained with resulting damage to both projectile and mortar.

Accordingly, embodiments of the present invention greatly increase the lifting efficiency of black powder by utilizing a burst chamber, and simultaneously provide a means of ignition for said projectiles. In some embodiments, the function of the bursting chamber is to spool the ignition of the black powder by forcing hot burning gases to travel within its granule matrix, followed by a controlled release of that burning matrix at bursting pressure.

In some embodiments, controlled release of that burning matrix as bursting pressure is achieved with greater effectiveness when the burst chamber is designed and manufactured to fail, e.g., split or burst open, at a bursting pressure between 100 and 800 psi, preferably between 250 and 550 psi.

The resulting hot, pressurized gases from a split bursting chamber are sufficient to reliably propel and ignite pyrotechnic projectiles, including reliably igniting primes and time delay fuses.

In some embodiments, the shape, dimensions and structure of a burst chamber (height, volume, material) and ullage can be varied by design for optimal performance. Herein, the ullage is considered to be the free space volume underneath the projectile when it is placed within a launch tune, e.g., excluding the burst chamber volume or other structure underneath the projectile. Test data that yield pressure/time profiles of working samples may provide the designer with the necessary performance attributes, such as bursting pressures and attenuated operating pressures as describe above.

For example, referring to FIG. 1 is shown an exemplary embodiment of a pyrotechnic device including a pyrotechnic projectile 4 which may be supported by a support structure 7 within a pyrotechnic launch structure 5 having wall(s) 5A. The launch structure 5 may be a tube including a circular in shape and may be closed at the bottom and open at the top to eject the fireworks projectile 4. A burst chamber 1 may be positioned to be spaced a predetermined distance below the support structure 7 and may be spaced a predetermined distance, e.g., equidistant, from the launch structure wall 5A to provide a predetermined amount of free space volume or ullage 6 e.g., around the burst chamber and under the projectile. The burst chamber 1 may fully enclose and contain a powder propellant charge 2, such as black powder.

Within the burst chamber 1 and in contact with the propellant powder charge 2 may be an ignition source 3, such as an electric match which may extend from (not shown) the bottom of the burst chamber or launch structure. A predefined amount of free space volume e.g., 2A may be included within the burst chamber, for example from about 0 to about 80 percent of the inner volume of the burst chamber.

In some embodiments, a second propellant such as nitrocellulose powder or fiber 9, such as commercially available nitrocellulose in fibrous form or any commercially available single, double, or triple-based smokeless powders, may be placed on or proximate to the outer surface of the burst chamber, such as on and around the bottom portion of the burst chamber 1 e.g., supported on the bottom portion of the launch structure 5.

In some embodiments, the volume of the burst chamber with respect to the free space volume underneath the projectile with a launch structure may be from about 1:1 to about 1:20.

Figure 2:
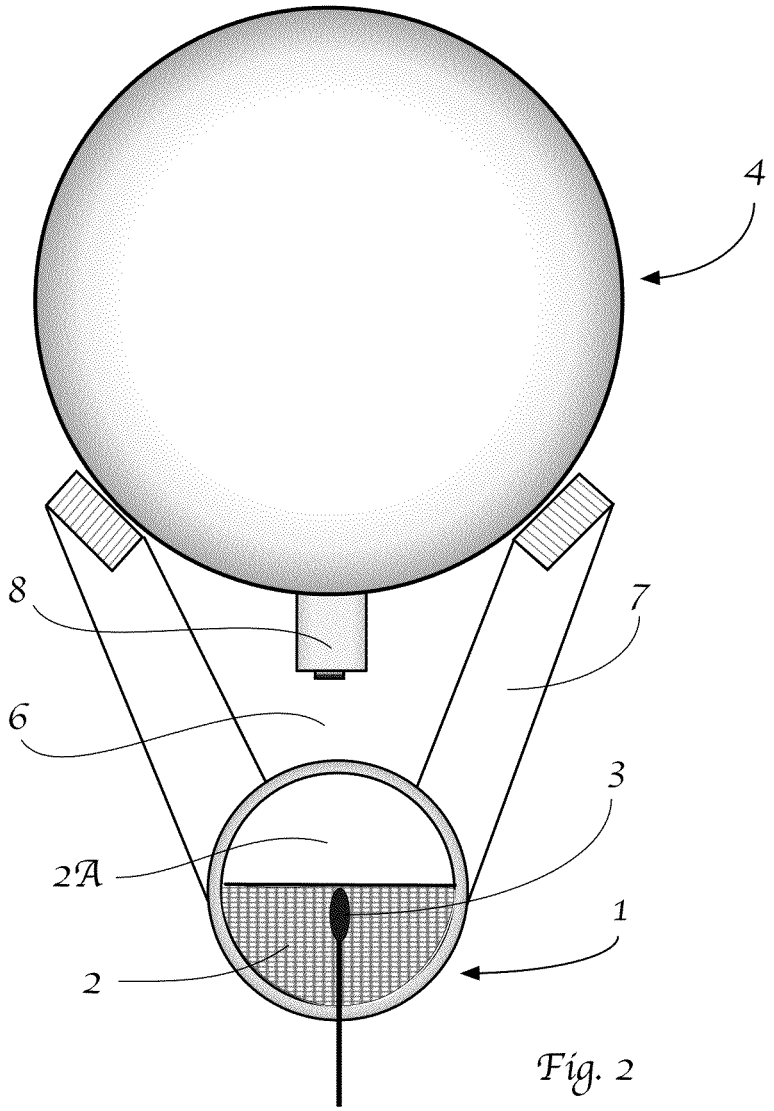
FIG. 2 is an illustration of another exemplary pyrotechnic device according to embodiments.

Referring to FIG. 2 is shown another exemplary embodiment of a pyrotechnic device including a spherical pyrotechnic projectile 4 supported on a support structure 7 with a burst chamber 1 disposed at the bottom of the support structure below the projectile 4 to define a predetermined volume or tree space 6 below the projectile 4 and above the burst chamber 1. When the pyrotechnic device is placed in a launch structure (not shown), the free space volume 6 will be included in the entire ullage (free space volume) underneath the projectile within a launch structure. A fuse 8 e.g., a time delay fuse, may extend from the bottom of the projectile 4, and is preferably ignited upon the release of ignited propellant powder from the burst chamber upon bursting. The burst chamber 1 may fully enclose and contain a powder propellant charge 2, such as black powder. Within the burst chamber 1 and in contact with the propellant powder charge 2 may be an ignition source 3, such as an electric match. A predefined amount of free space volume e.g., 2A may be included within the burst chamber, for example from about 0 to about 80 percent of the inner volume of the burst chamber.

In some embodiments, the burst chamber may be incorporated within the pyrotechnic device at the time of manufacture, for example the burst chamber 1 and projectile support structure 7 may be attached to either the launch structure/mortar or the projectile 4. In some embodiments, pyrotechnic devices may be packaged within a disposable cardboard mortar tube for immediate display setup. In other embodiments, specifically with larger pyrotechnic devices such as shells, only the lift charge including the burst chamber 1, and optionally a support structure 7, may be attached to the device and stored and transported in this manner. In some embodiments, shells and similar effects may be lowered into reusable mortars at the display site when readied for firing where either the shells or reusable mortar include a burst chamber and/or support structure to provide a predefined ullage volume underneath the projectile when placed within a launch structure. Embodiments of the present invention may include devices manufactured with or without included mortars. The above embodiments may ensure that no additional labor or expertise will be necessary at time of display setup, unlike that proposed by patent application U.S. Pat. No. 8,402,893, where launch kits and display items are handled and loaded separately.

Suitably, in some embodiments, the burst chamber may be constructed, from or include, paper, fiberboard, plastic, resin, fiber-filled resin, steel, stainless steel, brass, iron, cast iron, aluminum, or any other material capable of confining pressure. Preferably, the burst chamber material includes, or is made of paper, fiberboard, or plastic.

In some embodiments, burst chambers constructed of or including paper or fiber board may be suitable for pyrotechnics where the paper-based debris produced by ignition is of no concern. In other embodiments, such as in proximate displays, where the audience is positioned near the pyrotechnic show, the ejection of paper or similar debris from fireworks may be unacceptable. Likewise, certain display settings, such as football fields, basketball courts and ice skating surfaces, cannot be littered by ejected debris for aesthetic and safety reasons.

In some embodiments, burst chambers constructed of or including plastic, resin or fiber-filled resins may be more suitable for pyrotechnic devices that produce no ejected debris. In other embodiments, specific structures, shapes and designs can be incorporated into the burst chamber to release burning black powder at desired pressures without ejecting debris. Weak points or structurally weakened area patterns introduced into the burst chamber wall (s), such as by perforations, and/or partial slitting of a plastic chamber wall are some examples of designed and manufactured features that can cause the burst chamber to split at specific weak points, e.g., shaped as lines or petal leaf patterns as described below.

Figure 3A:
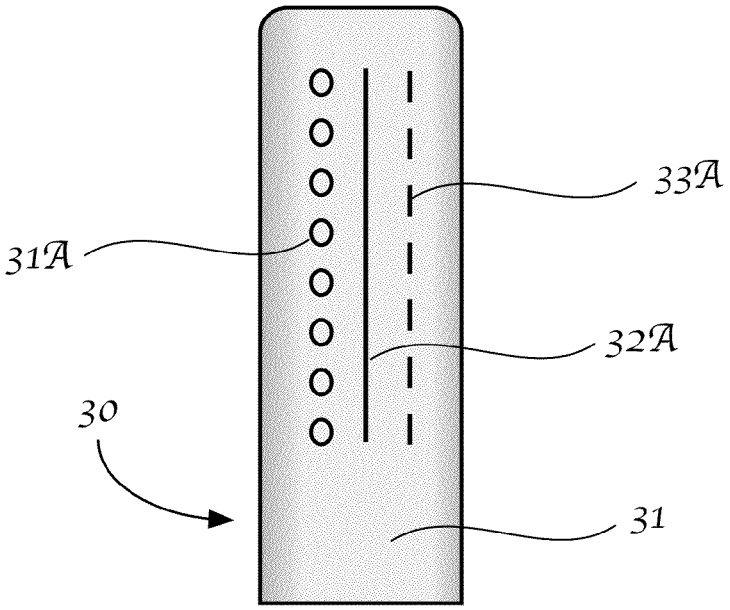
FIGS. 3A-3C are illustrations of exemplary structurally weakened areas introduced into exemplary pyrotechnic devices according to embodiments.
Figure 3B:
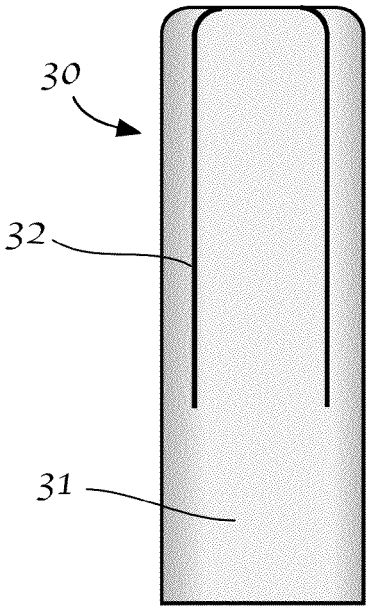

Referring to FIGS. 3A and 3B, are shown exemplary embodiments of structurally weakened areas introduced into a bursting chamber wall(s) to provide for preferential bursting or splitting of the chamber along the predefined weakened areas. The weakened wall areas in the burst chamber may be formed by any method including perforations or indentations introduced into the wall or by thinned wall areas and/or by wall areas formed of a second material different than that of the burst chamber.

For example, in FIG. 3A is shown structurally weakened areas that include perforations or indentations e.g., 31A, formed in an exemplary burst chamber 30 having wall 31 which contains e.g., black powder and an ignition source (not shown). The weakened areas may formed in a linear or curved pattern and may extend in any direction along the wall e.g., lengthwise, transverse or at an angle, or any combination of the foregoing. In addition, the weakened areas may include continuous or spaced slits e.g., 32A, 33A that may be formed in a linear or curved pattern and may extend in any direction along the wall. It will be appreciated that the structurally weakened areas may be any shape or combination or shapes and may extend fully through the burst chamber walls or only partially into the burst chamber walls.

Figure 3C:
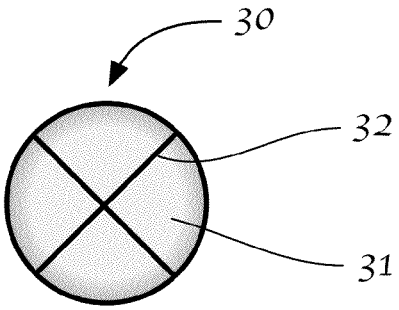

For example, shown in FIG. 3B are exemplary structurally weakened areas formed in an exemplary burst chamber 30 wall 31 having predefined patterns e.g., a petal-leaf type pattern 32 which is sore clearly seen from a top view in FIG. 3C, formed by continuous or spaced slits extending either fully or partially through the burst chamber walls. Further, the pattern e.g., 32 may include a different material than the major portion of the burst chamber wail 31, filling or partially filling the pattern 32. The weakened areas may further include variable widths and lengths and may be formed in any shape including linear or curved shapes. In addition, the weakened areas may be introduced into one or both of the interior and exterior portions of the burst chamber walls. It will further be appreciated that the burst chamber may be any shape including cylindrical, spherical or rectangular.

Embodiments are further supported by means of Examples below.

EXAMPLE 1

Traditional/prior art lift method. A primed 33 mm diameter comet with a single perforation and weighing 25 grams requires 13 grams of 3 FA black powder (1.2 to 2 mm diameter grains) for sufficient lifting was formed. The black powder was placed in an open plastic cup containing an electric match at the bottom. A comet was placed above the bed of black powder and the assembly shaken to remove all free volume in the effort to maximize confinement. A plastic film was placed above the comet and a cardboard mortar tube with a run length of 10 inches of suitable diameter was slipped over the assembly. To the back end of the mortar was placed a cardboard disk followed by potting with hot glue to secure the assembly.

Spooled lift method (including present embodiments): 2.5 grams of FFG black powder (0.6 to 1.2 mm diameter grains) was encapsulated in a thin-walled 2.2" long z ⅝" diameter low density polyethylene burse chamber containing an electric match. The chamber was perforated along its midsection with 5 punctures to create a weakened split-line. An identical-sized comet was suspended above the burst chamber in such a way as to provide about 5:1 ratio of free volume (ullage) below the comet to burst chamber volume. The card board mortar tube was identical with a run distance of 10 inches. The assembly was secured in a similar fashion with plastic film, disk and hot glue.

In comparing the above embodiments with the prior art example it was found that both devices provide suitable comet exit velocities between about 80 and about 100 meters/sec with pressures not exceeding about 110 psi. It was unexpectedly found that the above embodiment results in a percent reduction in the amount of necessary black powder necessary to achieve similar results of about (13-2.5)/13×100=81% compared to the prior art device.

EXAMPLE 2

Traditional/prior art lift method: Similar to the above assembly method described in Example 1, a primed one inch diameter comet (13 grams) required 5 grams of FG black powder (1.2 to 1.7 mm diameter grains) and a cardboard tube with 6 inches of run distance.

Spooled lift method (including present embodiments): 1.0 g of FFG black powder was encapsulated within a ⅞" diameter polystyrene sphere containing an electric match and was placed under an identical-sized comet with a 3:1 ullage to burst chamber volume. Assembly was similar to the above methods.

In comparing the above embodiment with the prior art example it was found that both devices provide suitable comet exit velocities of approximately 70-80 m/sec with lift pressures not exceeding 110 psi. It was unexpectedly found that the above embodiment results in a percent reduction in the amount of necessary black powder to achieve similar results of about (5−1)/5×100=80% compared to the prior art device.

EXAMPLE 3

Traditional/prior art lift method: Secured inside a thin polyethylene bag containing an electric match including 70 grams of FA powder (4 to 8 mm diameter grains). The bag of black powder was sealed to eliminate all free space. The bag was secured to the underside of a primed 3 inch comet with a large 0.75 inch center perforation with tape and lowered into a HDPE mortar tube of suitable diameter and run distance of 18 inches.

Spooled lift method (including present embodiments) augmented with nitrocellulose powder: Encapsulated inside a 1⅝ inch diameter polystyrene shell including 14 grams of FFG black powder and an electric match. An identical-sized comet was secured to the topside of strut-posts, whereby in the center of the posts was placed the sphere (burst chamber) containing the lift charge. Outside of the sphere was placed 2 grams of fibrous Type B nitrocellulose (13.55 % N content) to augment the lifting power of the black powder. Ullage to sphere ratio was 8:1. Mortar size and run distances are identical to that used in the traditional method.

Both the prior art device and the above embodiment provided suitable comet exit velocities of approximately 80-100 m/sec with lift pressures not exceeding 120 psi. It was unexpectedly found that the above embodiment results in a percent reduction in the amount of necessary black powder to achieve similar results of about (70−14)/70*100=80% compared to the prior art device.

Although the embodiments of this disclosure have been described with respect to certain exemplary embodiments, it is to be understood that the specific embodiments are for purposes of illustration and not limitation, as other variations will occur to those of skill in the art.

What is claimed is:

1. A pyrotechnic device comprising:

a projectile supported on a support structure, the support structure extending a predetermined distance below the projectile;

the projectile and support structure configured to be disposed within a launch structure;

a combustion chamber encapsulating a combustible powder, the combustion chamber attached to a bottom portion of the support structure;

an ignition source configured to ignite the combustible powder within the combustion chamber;

wherein the support structure comprises at least two separate support members; and, wherein at least two of the at least two support members each extend upwardly and outwardly from the combustion chamber to directly contact and support the projectile.

2. The pyrotechnic device of claim 1, wherein the support structure with the projectile and the combustion chamber disposed within the launch structure defines a predetermined amount of a free space volume extending from the combustion chamber to the walls and a closed bottom of the launch structure, the free space volume surrounding and contacting the combustion chamber and the projectile.

3. The pyrotechnic device of claim 2, wherein the free space volume is greater than or equal to a volume of the combustion chamber.

4. The pyrotechnic device of claim 3, wherein the free space volume has a volume ratio with respect to the combustion chamber of about 1:1 to about 20:1.

5. The pyrotechnic device of claim 1, wherein a wall of the combustion chamber wall comprises relatively structurally weakened areas disposed in a preselected pattern.

6. The pyrotechnic device of claim 5, wherein the preselected pattern comprises a petal leaf pattern.

7. The pyrotechnic device of claim 5, wherein the structurally weakened areas comprise at least one of slits, perforations, indentations, and a different material than the wall, the weakened areas extending at least partially through the wall.

8. The pyrotechnic device of claim 1, wherein the combustible powder comprises potassium nitrate (KNO3), carbon and sulfur.

9. The pyrotechnic device of claim 1, wherein the combustible powder comprises black powder.

10. The pyrotechnic device of claim 1, wherein the combustible powder has a particle size of about 0.1 mm to about 8 mm.

11. The pyrotechnic device of claim 1, wherein the combustion chamber is configured to burst at a predetermined pressure of between about 100 psi and about 800 psi.

12. The pyrotechnic device of claim 1, further comprising a combustible material proximate an exterior surface of the combustion chamber.

13. The pyrotechnic device of claim 12, wherein the combustible material comprises at least one of nitrocellulose and smokeless powder.

14. The pyrotechnic device of claim 1, wherein the combustion chamber and the support structure comprise one or more materials selected from the group consisting of paper, fiberboard, plastic, resin, fiber-filled resin, steel, stainless steel, brass, iron, cast iron, and aluminum.

15. The pyrotechnic device of claim 1, wherein the combustion chamber is at least partially filled with the combustible powder.

16. The pyrotechnic device of claim 15, wherein the combustion chamber is partially filled with the combustible powder up to about 80 percent of a total volume of the combustion chamber.

17. The pyrotechnic device of claim 1, further comprising a fuse extending from a bottom portion of the projectile, the fuse configured to be ignited upon combustion of the combustion chamber.

18. The pyrotechnic device of claim 1, wherein the at least two support members are spaced apart.

19. The pyrotechnic device of claim 1, wherein the launch structure comprises about the same diameter as the projectile.

20. A method of manufacturing a pyrotechnic device comprising:

providing a projectile supported on a support structure, the support structure extending a predetermined distance below the projectile;

configuring the projectile and support structure to be disposed within a launch structure;

providing a combustion chamber encapsulating a combustible powder, the combustion chamber attached to a bottom portion of the support structure;

providing an ignition source configured to ignite the combustible powder within the combustion chamber;

wherein the support structure is formed by providing at least two separate support members; and, wherein at least two of the at least two support members are each provided extending upwardly and outwardly from the combustion chamber to directly contact and support the projectile.

* * * * *